US005101783A

United States Patent [19]

Car et al.

[11] Patent Number: 5,101,783

[45] Date of Patent: Apr. 7, 1992

[54] IGNITION SYSTEM AND SPARK PLUG FOR MULTIPLE IGNITION IN AN INTERNAL COMBUSTION ENGINE

[75] Inventors: Martin Car, Grossenhausen; Erich Pöhlmann, Kulmbach, both of Fed. Rep. of Germany

[73] Assignee: Didier-Werke AG, Wiesbaden, Fed. Rep. of Germany

[21] Appl. No.: 648,811

[22] Filed: Feb. 4, 1991

[30] Foreign Application Priority Data

Feb. 2, 1990 [DE] Fed. Rep. of Germany ..... 4003021

[51] Int. Cl.[5] ..... F02P 15/02

[52] U.S. Cl. ..... 123/310; 123/169 C

[58] Field of Search ..... 123/169 C, 310, 41.31, 123/41.82 R, 638

[56] References Cited

U.S. PATENT DOCUMENTS

| | | | |
|---|---|---|---|
| 1,235,993 | 8/1917 | Miller | 123/310 |
| 1,962,078 | 6/1934 | Kegresse | 123/169 C |
| 1,962,079 | 6/1934 | Kegresse | 123/169 C |
| 2,025,202 | 12/1935 | Harper | 123/310 |
| 2,050,688 | 8/1936 | Barkeij | 123/310 |
| 4,625,682 | 12/1986 | Dietrich et al. | 123/41.31 |

FOREIGN PATENT DOCUMENTS

| | | | |
|---|---|---|---|
| 0001734 | 1/1978 | Japan | 123/169 C |
| 99121 | 8/1921 | Switzerland . | |
| 1390894 | 4/1975 | United Kingdom | 123/41.82 |

*Primary Examiner*—Tony M. Argenbright

*Attorney, Agent, or Firm*—Wenderoth, Lind & Ponack

[57] ABSTRACT

An ignition system in an internal combustion engine having a cylinder housing with an air or water cooled region achieves multiple ignition. The ignition system includes at least a pair of spark plugs electrically connected in series and including a first spark plug mounted in the cylinder housing while being isolated electrically therefrom and a second spark plug directly screwed into a cylinder head of the cylinder housing. The first spark plug is mounted within the air or water cooled region of the cylinder housing, thereby maintaining such spark plug at a relatively constant temperature, and avoiding the problem of the two spark plugs being subjected to different thermal stresses.

36 Claims, 2 Drawing Sheets

IGNITION SYSTEM AND SPARK PLUG FOR MULTIPLE IGNITION IN AN INTERNAL COMBUSTION ENGINE

BACKGROUND OF THE INVENTION

The present invention relates to an ignition system, for use in an internal combustion engine having a cylinder housing with an air or water cooled region, for achieving multiple ignition by means of at least a pair of spark plugs connected electrically in series and including a first spark plug mounted in the cylinder housing while being electrically isolated therefrom and the second spark plug mounted directly, for example by threading, into a cylinder head of the cylinder housing. The present invention further relates to an assembly of components of an internal combustion engine including a cylinder housing thereof in combination with such an ignition system. Yet further, the present invention relates to a spark plug for use in such an ignition system for use in such an assembly.

An ignition system of this general type is disclosed in Swiss CH-PS 29 121. Such ignition system makes it possible to achieve multiple ignition with a single ignition coil and single interruptor or distributor, thus achieving a cost savings.

In the construction of airplane engines it has been the practice for some time to employ two conventional spark plugs and two ignition systems for safety reasons. For high quality passenger automotive vehicles, dual ignition with two spark plugs per cylinder and two ignition coils with related accessories also are known. Such arrangements however are expensive. Additionally, the use of conventional spark plugs in such dual ignition systems results in a disadvantage that the spark plugs are subjected to different thermal stresses with different engines and with different operating conditions or methods of driving.

The use of multiple ignition systems for internal combustion engines, particularly for engines of automotive vehicles, recently has been examined with renewed interest since such systems achieve a reduction in pollution due to better combustion of fuel.

SUMMARY OF THE INVENTION

With the above discussion in mind, it is an object of the present invention to provide an improved ignition system capable of achieving multiple ignition and that has the advantages thereof, but that is improved to avoid the expense of two complete ignition systems. It is a further object of the present invention to provide such an improved ignition system wherein it is possible to overcome the above and other prior art disadvantages. It is a yet further specific object of the present invention to provide such an improved ignition system wherein it is possible to eliminate or at least to significantly reduce problems of different thermal stresses acting on different spark plugs in such an ignition system.

It is an even further object of the present invention to provide an assembly including such an improved ignition system in cooperation with at least components of an internal combustion engine. It is a yet further objection of the present invention to provide an improved spark plug structure employable in such ignition system and assembly.

The above objects are achieved in accordance with the present invention by providing that the ignition system includes at least a pair of spark plugs connected electrically in series and including a first spark plug mounted in a cylinder housing of an internal combustion engine while being electrically isolated therefrom and a second spark plug that is directly screwed into a cylinder head of the cylinder housing, with the first spark plug mounted within an air or water cooled region of the cylinder housing. By this structural arrangement, the first spark plug can be maintained at a substantially constant temperature, and this is achieved by utilization of the cooling region of the invention. Thus, the problem of the two spark plugs being subjected to different thermal stresses is eliminated or at least significantly reduced without the need for additional structural modifications of the engine, since the cooling region already must be provided in the engine. As a result, the advantage of the present invention is achieved by means of already existing structural features of the engine, the electrically isolated spark plug of the multiple ignition system simply being mounted within such cooling region of the engine. As a result, the ignition system and assembly of the present invention exhibit the advantages of known dual or multiple ignition systems in internal combustion engines without having to accept the previously unavoidable problem of different thermal stresses acting on different of the spark plugs.

A particularly good cooling effect is achieved when the electrically isolated spark plug extends through and across a space of the cylinder housing through which flows air or water cooling fluid. In this manner, the electrically isolated spark plug is directly cooled.

A particularly advantageous design of the invention provides that the electrically isolated spark plug is screwed into an outer shell of the cylinder housing and is sealed with respect to an inner shell of the cylinder housing, such two shells defining the cooling space, and wherein electrodes of the spark plug project through an opening in the inner shell into the particular combustion chamber of the engine. Electrical isolation of the spark plug can be attained in an advantageous manner according to another feature of the present invention in that the electrodes are formed by heat resistant metal wires that are accommodated in respective bores of a ceramic insulator which extends through and across the air or water cooled space of the cylinder housing. The insulator can be protected in the area extending across the air or water cooled space without negative impact on cooling thereof by having the insulator positioned within a metal pipe formed, for example, of stainless steel. Such metal pipe can serve in an advantageous manner to assemble the electrically isolated spark plug, in that the metal pipe can be threaded into the outer shell of the cylinder housing. For example, a conventional threaded spark plug opening can be employed to receive such metal pipe. To obtain the necessary sealing of the insulator with respect to the air or water cooled space, the metal pipe can have an inner end that abuts preferably sealingly against the inner shell of the cylinder housing.

BRIEF DESCRIPTION OF THE DRAWING

Other objects, features, advantages and possible applications of the present invention will be apparent from the following detailed description, taken with the accompanying drawing, wherein.

DETAILED DESCRIPTION OF THE INVENTION

Figure 1:
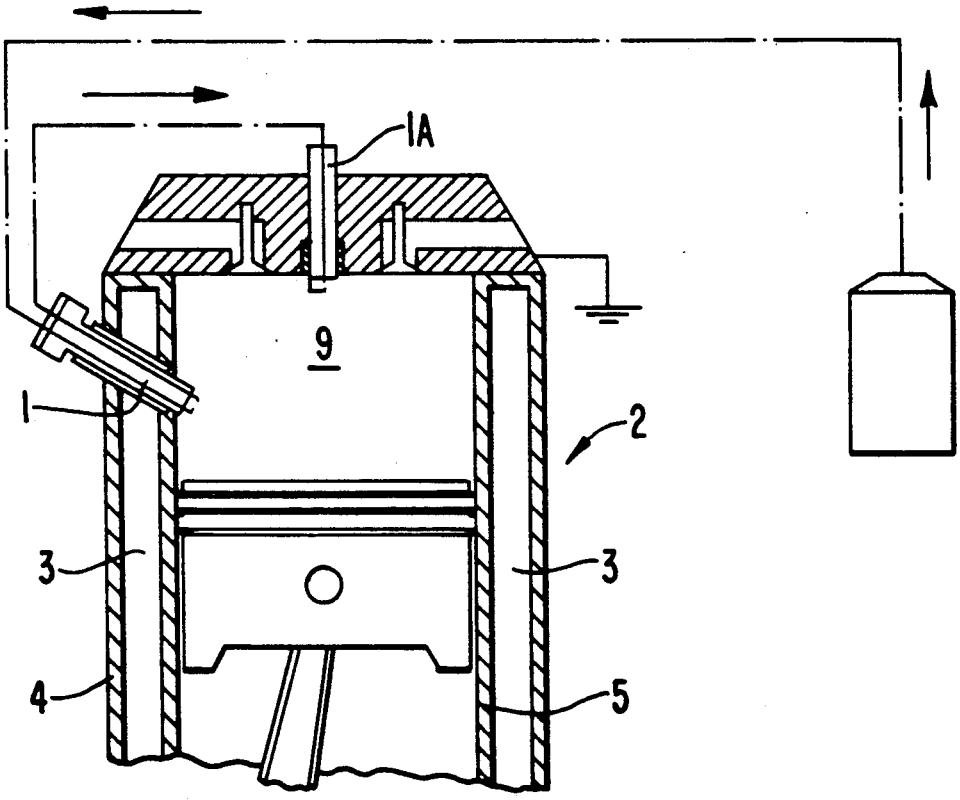
FIG. 1 is a schematic sectional view of an electrically isolated spark plug in accordance with the present invention shown mounted within a cylinder housing of an internal combustion engine and forming a portion of an ignition system and an assembly in accordance with the present invention and FIG. 2 is an enlarged view in greater detail of the electrically isolated spark plug of the invention.
Figure 2:
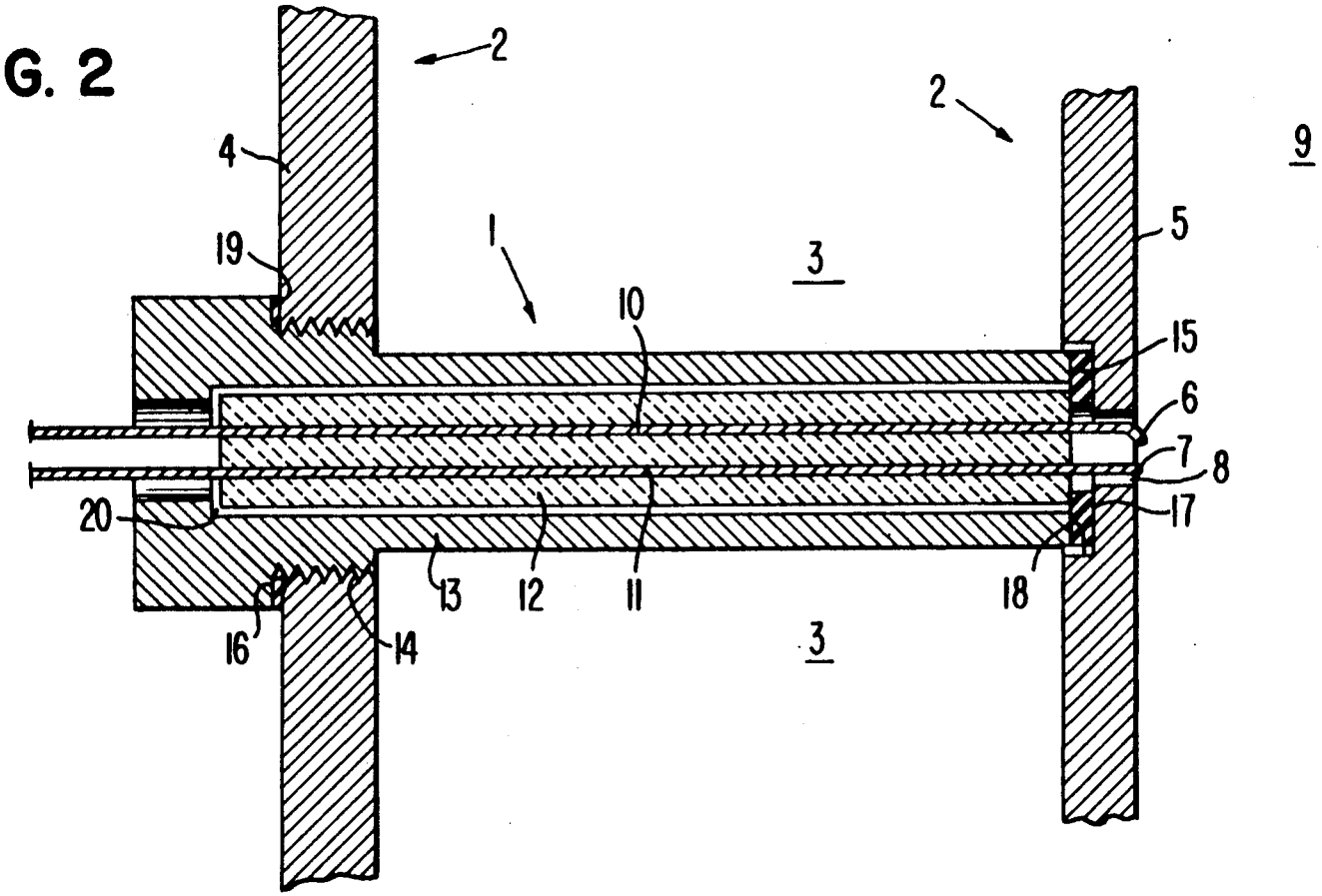

In FIG. 1 is illustrated schematically a spark plug 1 according to the invention and assembled in a cooled region of a cylinder housing 2 of an internal combustion engine. Spark plug 1 is connected electrically in series with another, conventional spark plug 1A that is screwed into a cylinder head of the cylinder housing in a normal manner, to thereby form an ignition system for achieving multiple ignition within a combustion chamber 9 of the engine. Such other, conventional spark plug and the series electrical connection between such other spark plug 1A and spark plug 1 are intended to be conventional and may be, for example, as disclosed in the above mentioned Swiss patent.

Cylinder housing 2, in the cooled region thereof, is formed of an outer shell 4 and an inner shell 5 that define therebetween a space 3 through which flows a cooling fluid. It is contemplated that the cooling fluid in the illustrated embodiment be water or water and antifreeze. Air cooled regions are known however and could be employed.

The spark plug 1 of the present invention, thus forming part of a multiple ignition system in accordance with the present invention, is arranged to extend through and across space 3 to form an assembly in accordance with the present invention. Particularly, spark plug 1 has two electrodes 6; 7 that are formed by heat resistant metal wires and that are arranged in respective longitudinal bores 10, 11 of a cylindrical ceramic insulator 12. Inner free ends of electrodes 6, 7 project from insulator 12 through an opening 8 formed in inner shell 5 into combustion chamber 9. Insulator 12 is received within a cylindrical metal pipe 13, for example formed of stainless steel. An inner end of pipe 13 has an end face 15 facing the inner shell 5 that abuts a sealing ring 17 arranged within a recess 18 in inner shell 5. An inner end of insulator 12 also abuts sealing ring 17. An outer end of metal pipe 13 is threaded at 14 and thereby screwed into a threaded opening in outer shell 4. The portion of metal pipe 13 extending outwardly of outer shell 4 has an enlarged size forming a shoulder 19, and a sealing ring 16 is pressed between shoulder 19 and the outer surface of outer shell 4. Insulator 12 has an outer end that abuts an inner shoulder 20 of metal pipe 13. By this arrangement, the threading of metal 13 into the threaded opening in outer shell 4 causes the inner end of metal pipe 13 to abut sealingly against seal ring 17 that is pressed between end 15 of pipe 13 and inner shell 5. At the same time, insulator 12 is positioned axially by abutment of the outer end thereof with inner shoulder 20 of metal pipe 13 and by the inner end of insulator 12 abutting sealing ring 17. Outer ends of electrodes 6, 7 extend axially outwardly through the axial opening through metal pipe 13. This arrangement provides a firm mounting and axial positioning of insulator 12. By this arrangement, the spark plug 1 is electrically isolated from the cylinder housing 2.

Although the present invention has been described and illustrated with respect to preferred features thereof, it is to be understood that various modifications and changes may be made to the specifically described and illustrated features without departing from the scope of the present invention. It particularly is to be understood that all of the described and/or illustrated features form by themselves or in any arbitrary logical combination the subject matter of the present invention, independently of the specifically described and illustrated arrangements.

We claim:

1. In an assembly including a cylinder housing of an internal combustion engine with a fluid cooled region and an ignition system for achieving multiple ignition by means of at least a pair of spark plugs electrically connected in series and including a first spark plug that is mounted in said cylinder housing while being electrically isolated therefrom and a second spark plug that is directly screwed into a cylinder head of said cylinder housing, the improvement wherein:

said first spark plug is mounted within said cooled region of said cylinder housing.

2. The improvement claimed in claim 1, wherein said cooled region comprises a space defined in said cylinder housing and through which cooling is to flow, and said first spark plug extends across and through said space.

3. The improvement claimed in claim 2, wherein said space is defined between an outer shell of said cylinder housing and an inner shell of said cylinder housing.

4. The improvement claimed in claim 3, wherein said inner shell has therethrough an opening communicating with a combustion chamber, and said first spark plug includes electrodes extending across said space and through said opening into said combustion chamber.

5. The improvement claimed in claim 4, wherein said electrodes comprise heat resistant metal wires.

6. The improvement claimed in claim 4, wherein said first spark plug further includes a ceramic insulator extending across and through said space, and said electrodes are accommodated in respective bores in said insulator.

7. The improvement claimed in claim 6, wherein said first spark plug further includes means for mounting said insulator and said electrodes between said outer and inner shells while electrically isolating said electrodes therefrom.

8. The improvement claimed in claim 7, wherein said mounting means comprises a metal pipe surrounding said insulator.

9. The improvement claimed in claim 8, wherein said metal pipe is formed of stainless steel.

10. The improvement claimed in claim 8, wherein said metal pipe has an outer end that is threaded into said outer shell.

11. The improvement claimed in claim 10, wherein said metal pipe has an inner end sealingly abutted against said inner shell.

12. The improvement claimed in claim 8, wherein said insulator has an outer shell abutting a step formed in said metal pipe.

13. The improvement claimed in claim 12, wherein said insulator has an inner end abutted against a seal pressed against said inner shell.

14. The improvement claimed in claim 8, wherein said metal pipe has an inner end sealingly abutted against said inner shell.

15. In an ignition system, for use in an internal combustion engine having a cylinder housing with a fluid cooled region, for achieving multiple ignition by means of at least a pair of spark plugs electrically connected in series and including a first spark plug to be mounted in the cylinder housing while being electrically isolated therefrom and a second spark plug to be directly screwed into a cylinder head of the cylinder housing, the improvement wherein:

said first spark plug includes means for mounting said first spark plug within the cooled region of the cylinder housing.

16. The improvement claimed in claim 15, wherein the cooled region is to include a space defined in the cylinder housing and through which cooling fluid is to flow, such space to be defined between outer and inner shells of the cylinder housing with the inner shell to have therethrough an opening to communicate with a combustion chamber, and said first spark plug comprises electrodes dimensioned to extend across such space and through such opening into such combustion chamber.

17. The improvement claimed in claim 16, wherein said electrodes comprise heat resistant metal wires.

18. The improvement claimed in claim 16, wherein said first spark plug further comprises a ceramic insulator dimensioned to extend across and through the space, and said electrodes are accommodated in respective bores in said insulator.

19. The improvement claimed in claim 18, wherein said means for mounting includes means for positioning said insulator and said electrodes between the outer and inner shells while electrically isolating said electrodes therefrom.

20. The improvement claimed in claim 19, wherein said positioning means comprises a metal pipe surrounding said insulator.

21. The improvement claimed in claim 20, wherein said metal pipe is formed of stainless steel.

22. The improvement claimed in claim 20, wherein said metal pipe has an outer end that has threads to be threaded into the outer shell.

23. The improvement claimed in claim 22, further comprising means for sealingly abutting an inner end of said metal pipe against the inner shell.

24. The improvement claimed in claim 20, wherein said insulator has an outer end abutting a step formed in said metal pipe.

25. The improvement claimed in claim 24, wherein said insulator has an inner end abutted against a seal to be pressed against the inner shell.

26. The improvement claimed in claim 20, further comprising means for sealingly abutting an inner end of said metal pipe against the inner shell.

27. A spark plug to be electrically connected in series and used with a second spark plug to form an ignition system capable of achieving multiple ignition in an internal combustion engine having a cylinder housing with a fluid cooled region comprising outer and inner shells defining therebetween a space through which is to flow cooling fluid, said spark plug comprising:

electrodes dimensioned to enable mounting thereof at a position to extend through the outer shell of the cylinder housing, across the space between the outer and inner shells thereof, and through the inner shell into a combustion chamber defined within the inner shell thereof; and means for mounting said electrodes in such a position while maintaining said electrodes electrically isolated from the inner and outer shells of the cylinder housing.

28. A spark plug as claimed in claim 27, wherein said electrodes comprise heat resistant metal wires.

29. A spark plug as claimed in claim 27, wherein said mounting means comprises a ceramic insulator dimensioned to extend across and through the space, and said electrodes are accommodated in respective bores in said insulator.

30. A spark plug as claimed in claim 29, wherein said mounting means further comprises a metal pipe surrounding said insulator.

31. A spark plug as claimed in claim 30, wherein said metal pipe is formed of stainless steel.

32. A spark plug as claimed in claim 30, wherein said metal pipe has an outer end that has threads to be threaded into the outer shell.

33. A spark plug as claimed in claim 32, further comprising means for sealingly abutting an inner end of said metal pipe against the inner shell.

34. A spark plug as claimed in claim 30, wherein said insulator has an outer end abutting a step formed in said metal pipe.

35. A spark plug as claimed in claim 34, wherein said insulator has an inner end abutted against a seal to be pressed against the inner shell.

36. A spark plug as claimed in claim 30, further comprising means for sealingly abutting an inner end of said metal pipe against the inner shell.

* * * * *